US005608505A

United States Patent [19]

Takeuchi et al.

[11] Patent Number: 5,608,505

[45] Date of Patent: Mar. 4, 1997

[54] IMAGE FORMING APPARATUS

[75] Inventors: Akihiko Takeuchi, Yokohama; Toshihiko Ochiai, Tokyo; Motoi Katoh, Yokohama; Toshiaki Miyashiro, Ichikawa; Takehiko Suzuki, Yokohama, all of Japan

[73] Assignee: Canon Kabushiki Kaisha, Tokyo, Japan

[21] Appl. No.: 640,000

[22] Filed: Apr. 30, 1996

Related U.S. Application Data

[63] Continuation of Ser. No. 266,684, Jun. 28, 1994, abandoned.

[30] Foreign Application Priority Data

Jun. 29, 1993 [JP] Japan ..... 5-159051

[51] Int. Cl.[6] ..... G03G 15/16

[52] U.S. Cl. ..... 399/314; 399/315; 399/298

[58] Field of Search ..... 355/271, 273, 355/308, 326 R, 210, 211

[56] References Cited

U.S. PATENT DOCUMENTS 5,253,022 10/1993 Takeuchi et al. ..... 355/274
5,272,506 12/1993 Goto et al. ..... 355/271 X

FOREIGN PATENT DOCUMENTS 0281138 9/1988 European Pat. Off. .
0513819 11/1992 European Pat. Off. .
2607727 9/1976 Germany .
50-93437 7/1975 Japan .
60-51864 3/1985 Japan .
60-83068 5/1985 Japan .
2-108091 4/1990 Japan .
50-50935 5/1995 Japan .
92-14193 8/1992 WIPO .

*Primary Examiner*—Nestor R. Ramirez
*Attorney, Agent, or Firm*—Fitzpatrick, Cella, Harper & Scinto

[57] ABSTRACT

An image forming apparatus includes an electrophotographic photosensitive member; a charger for charging the photosensitive member to form an electrostatic latent image on the photosensitive member; an exposure device for exposing the photosensitive member to image light; a developing device for developing the latent image with toner; a transfer member contactable to the photosensitive member at a transfer position, the transfer member comprising an electrically conductive base, a high resistance surface layer, and a low resistance or intermediate resistance conductive layer between the conductive base and the surface layer; and transfer voltage applying device for applying a transfer voltage to the transfer member; wherein Ws>Wt>Wp>W1 is satisfied, where Ws is a width of a photosensitive layer measured in a direction perpendicular to a movement direction of the photosensitive member, W1 is an image exposure width of the exposure device, Wp is a width of a transfer material usable with the image forming apparatus, and Wt is an overlapping width between a charging width of the charger and the width of the conductive layer of the transfer member.

19 Claims, 6 Drawing Sheets

IMAGE FORMING APPARATUS

This application is a continuation of U.S. application Ser. No. 08/266,684 filed Jun. 2, 1994 now abandoned.

FIELD OF THE INVENTION AND RELATED ART

The present invention relates to a color image forming apparatus in which respective color toner images formed on an image bearing member having an electrophotographic photosensitive member are sequentially transferred onto a transfer material to provide a color image.

In an example of a color image forming apparatus in which a color image is formed on a transfer material by superposing multiple color toner images, a toner image is formed on an image bearing member through charging, exposure and development, and the toner image is transferred onto a transfer material after each color toner image is formed, and this is repeated for the respective colors, by which a superposed color image is formed on the transfer material. Examples of the color image forming apparatus are disclosed in German Patent No. 2607727, Japanese Laid-Open Patent Application No. 50-50935 or the like. FIG. 5 is a longitudinal sectional view of an example of such a color image forming apparatus. As shown, the apparatus is provided with an electrophotographic photosensitive drum 1 as an image bearing member. Around the photosensitive drum 1, there are provided a primary charger 3 in the form of a roller electrode, rotary type developing device 4 having a plurality of developing units, a transfer device 10A and a cleaning device 26. Above the photosensitive drum 1, there is a laser diode 11 constituting an exposure device, a polygonal mirror 13 rotated by a high speed motor 12, and a lens 14 and a reflection mirror 15.

The photosensitive drum 1 comprises an aluminum cylinder having a diameter of 40 mm and an organic photoconductor (OPC) thereon. The photoconductor may be an amorphous silicon, CdS, Se or the like. The photosensitive drum 1 is rotated in a direction indicated by an arrow at a peripheral speed of 100 mm/sec by an unshown driving means.

The developing device 4 is provided with a supporting member 9 rotatable about a shaft 9*a*, the supporting member 9 supports a yellow developing device 4*a*, a magenta developing device 4*b*, a cyan developing device 4*c* and a black developing device 4*d*. The developing devices 4*a*, 4*b*, 4*c* and 4*d* contain one component developers, more particularly, yellow toner, magenta toner, cyan toner, black toner, respectively.

In each of the developing devices 4*a*, 4*b*, 4*c* and 4*d*, as shown in FIG. 6, there is provided a developing sleeve 8*a*, 8*b*, 8*c* and 8*d* as the developer carrying member in the openings 5*a*, 5*b*, 5*c* and 5*d*. In each of the developing devices 4*a*, 4*b*, 4*c* and 4*d*, there are application roller 6*a*, 6*b*, 6*c* and 6*d*, and toner regulating member 7*a*, 7*b*, 7*c* and 7*d*. With the rotation of the developing sleeve 8*a*, 8*b*, 8*c* and 8*d*, toner is applied by the application roller 6*a*, 6*b*, 6*c* and 6*d* on the developing sleeve 8*a*, 8*b*, 8*c* and 8*d*. The toner regulating member 7*a*, 7*b*, 7*c* and 7*d* regulates the toner and applies triboelectric charge to the toner to provide a thin toner layer on the developing speed 8*a*, 8*b*, 8*c* and 8*d*. The toner regulating members 7*a*–7*d* are preferably made of a material charged to the polarity opposite from that of the toner. When the toner is to be charged to the negative polarity, the material may be nylon or the like, and when it is to be charged to the positive polarity, silicone rubber or the like is preferable.

The peripheral speed of the developing sleeve 8*a*–8*d* of each of the developing devices 4*a*–4*d*, is preferably determined so as to be 1.0–2.0 times the peripheral speed of the photosensitive drum 1. When each of the developing devices 4*a*–4*d* is faced to the photosensitive drum, the opening 5*a*–5*d* is always faced to the photosensitive drum 1. The method of so driving the developing device 4*a*–4*d*, is disclosed in Japanese Laid-Open Patent Application No. 93437/1975.

The transfer device 10*a* is provided with a transfer drum 10 as a transfer material carrying member, and around the transfer drum 10, there are attraction roller 23, charge removing discharger 2, separation claws, cleaner 27 and discharging roller 28. The transfer drum 10 is provided with grippers 22 at a position on the outer peripheral for gripping the transfer material. The transfer drum 10 is rotated in the direction indicated by an arrow substantially at the same peripheral speed of the photosensitive drum, by an unshown driving means.

On the other hand, to the transfer drum 10 of the transfer device 10*a*, a transfer material is fed from a transfer material cassette 17 in synchronism with an image on the photosensitive drum 1, by a pick-up roller.

By rotation in the direction of the arrow while holding the transfer material by the gripper 22, the transfer drum 10 feeds the transfer material to the image transfer station. The transfer sheet in the transfer station receives the toner image of each of the colors from the photosensitive drum 1 by the transfer voltage applied between the transfer drum 10 and the photosensitive drum 1 by an unshown voltage source.

The image forming methods are generally classified into a regular development method in which non-exposed area of the photosensitive member receives the toner, and a reverse development in which the area exposed to light receives the toner image. In the case of the regular development, the photosensitive drum 1 uniformly charged by a charging means 3 is exposed to image light, and the toner is deposited on the non-exposed portion of the charged area, and therefore, the charge polarity of the toner is opposite from that of the polarity provided by the charging means 3. In the transfer operation, the transfer drum 10 is supplied with a transfer voltage having the same polarity as the charge of the photosensitive member and of a voltage level having an absolute value larger than that of the primary charge, so that the toner is transferred from the photosensitive drum 1 onto the transfer sheet.

On the other hand, in the case of reverse development, the photosensitive drum 1 uniformly charged by the charging means 3 receives the toner only at the exposed portion of the charged area of the photosensitive drum 1. Therefore, the polarity of the toner is the same as the polarity of the charge provided by the charging means 3, contrary to the case of the regular development. During the transfer operation, the transfer drum 10 is supplied with a transfer voltage of the polarity opposite from that of the charged polarity of the photosensitive drum 1, so that the toner is transferred from the photosensitive drum 1 onto the transfer material.

In either of the regular or reverse developing method, the development and transfer operations are repeated by the developing devices 4*a*, 4*b*, 4*c* and 4*d*, and the four color toner images are superimposed on the transfer material, in order to provide the color image.

At this time, the electric charge is injected into the transfer material by the transfer voltage in the transfer operation, and the transfer material is electrostatically attracted and retained on the surface of the transfer drum. In order to enhance the electrostatic attraction of the transfer material onto the transfer drum 10, an attraction roller 23 is disposed adjacent to the sheet feeding portion of the transfer material to the transfer drum 10 to apply an attraction voltage, by which the transfer material is electrostatically attracted beforehand after it is gripped by the gripper.

The transfer sheet having been subjected to the transfer operation to receive the four color toner images, is electrically discharged by discharger 2 disposed adjacent to the transfer drum 10, and thereafter, it is separated from the transfer drum 10 by the downstream separation claws 24, and it is fed to an image fixing device 25. There, the four color toner images are fixed by heat and pressure to fix the mixed toner images on the transfer material into a permanent full-color image. Thereafter, it is discharged outside the image forming apparatus. Preferably, the transfer drum 10 from which the transfer material has been removed, is cleaned by a cleaner 27 having a cleaning member such as a fur brush or web or the like, so that the toner remaining on the surface is removed.

Substantially, simultaneously with separation of the transfer material from the transfer drum 10 by separation claws 24, the discharging roller 28 is contacted to the transfer drum 10 so as to discharge the surface of the transfer drum by an AC voltage (the AC voltage biased with a DC voltage) applied to the discharging roller 28.

In a conventional electrophotographic apparatus, it is difficult to transfer a toner image on the entire area of the transfer material in consideration of small image deviation or the like. In order to prevent contamination of transfer means or wrapping of the transfer material around the fixing material, it is frequent that a blank is provided at an end of the transfer material. In addition, when a master of design is produced, a sheet which is larger than a regular size may be used (for example, a blead size for a letter size is larger by 1 inch and by ½ inch approximately, in the vertical and horizontal directions, respectively). In this case, a blank is formed around the sheet. The portion without the blank is called effective image area. When the width of the effective image area in the direction of an axis of the photosensitive drum (exposure width in the case of reverse development) is Wl, a width of development of the developing device is Wd, and charging width of the charging means is Wc, generally, the following is satisfied.

$$Wl \leqq Wd \leqq Wc \quad \text{(A), or}$$

$$Wl \leqq Wc \leqq Wd. \quad \text{(B)}$$

By doing so, the resultant image does not have a missing part.

In a regular developing method, the above (A) and (B) are satisfactory. However, in the reverse development, the above (B) results in black stripes in the blank of the transfer sheet, or the transfer means and the feeding means may be contaminated. Therefore, it has been proposed that the above (A) is satisfied, in Japanese Utility Model Application Publication No. 44213/1986, for example.

As regards the width Wp of the transfer material per se measured along the length of the photosensitive drum, there are cases of $Wd \geqq Wp$ and $Wd < Wp$, because a larger size sheet is used on purpose and because the problem of the missing image does not arise in the blank portion.

On the other hand, as regards the transfer means 10*a*, it is apparent that the transfer area is larger than the effective image width Wl. However, no limitation has been imparted to the transfer material width Wp, development width Wd or charging width Wc. As regards the transfer apparatus of a transfer drum type, there are two types in one of which a thin dielectric sheet is formed into a hollow cylinder (hollow transfer drum) and an electroconductive elastic material 10*b* or the like is provided behind a thin dielectric sheet 10*c*, and a voltage is applied to an electroconductive base 10*a* (solid transfer drum). In the former case, that is, the hollow transfer drum, the charging is effected by corona charging or the like to the front or back side of the drum for each of the stations for attraction, transfer and separation, and therefore, the apparatus becomes complicated. However, there are no interferences in the charging action among the stations, and therefore, this type is widely used.

In the case of the solid transfer drum, the bias voltage is applied to the conductive base 10*a*, and therefore, the structure is simple, but the respective stations are not electrically independent. The transfer, attraction, separation or other process operations are carried out by transfer of electric charge between the transfer drum, the attraction roller, the discharging roller 28 and the dielectric sheet 10*c*, the transfer material, with the conductive elastic material functioning as an opposite electrode, and therefore, as compared with the hollow structure, voltage conditions and the voltage application timings are more limited than in the hollow type.

Particularly, when the transfer material is attracted to the transfer drum 10, the auxiliary attraction force due to the attraction roller 28 is not so strong as compared with the attraction or the like due to the corona charge by the hollow transfer drum. Mainly, the electric charge is applied to the surface of the transfer material to the surface of the photosensitive drum 1 and the transfer drum 10, and the attraction is effected by the charge and the charge induced to the backside of the dielectric sheet 10*c*. In the case of full-color transfer operation in which the drum is rotated through at least four turns, the transfer material is retained on the transfer drum 10.

Accordingly, it is required that the photosensitive drum 1 as a charge supply source and an electroconductive layer 10*b* functioning as an opposite electrode are overlapped in the entire longitudinal direction of the transfer material for the purpose of attraction.

As a result of the investigations made by the inventors the following has been found. If the charging width Wc is not more than the width Wb of the transfer material, no particular inconvenience occurs in the case of the regular development. However, if this is so under the condition that the above-described conditions are satisfied, the attraction force at an end of the transfer material is weak in the case of reverse development. If a part of the transfer material is raised from the transfer drum, a deviation occurs between the transfer drum 10 and the transfer material when the color toner images are sequentially overlaid on the transfer material through the transfer step, even to the extent that the transfer material is separated. In the case of solid transfer drum, the backside charge moves laterally through the electroconductive layer, the sheet is peeled gradually from the raised portion. In the case of the regular development, the potential of the photosensitive drum in the neighborhood of the opposite ends of the transfer material is non-charging potential. The potential is approx. 0 volt actually. This is substantially the same as the light potential in the background in the image region, and therefore, the attraction at the end may be strong (the same polarity charge may be effected by the transfer drum as the case may be).

More particularly, in the case of the regular development, a strong electric field as compared with the dark potential in the portion having the toner is formed between the electroconductive layer 10*b* supplied with a bias voltage having an absolute value larger than the charge potential and having the same polarity as that, and therefore, the corresponding sufficient electric charge is applied or induced to the transfer material and-the dielectric layer 10*c*. Therefore, the peripheral of the transfer sheet is strongly attracted.

However in the case of reverse development, the potential on the photosensitive drum 1 adjacent the opposite end portions of the transfer material is approx. 0 volt (non-charging potential) (it may be charged to the polarity opposite from the dark potentially by the transfer drum as the case may be). On the other hand, the white background portion in the image area has a dark potential. Therefore, when the transfer bias voltage having the polarity opposite from that the dark potential, that is, the transfer potential, is applied to the electroconductive layer 10*b* during the transfer operation, the electric field between the photosensitive member 1 and the conductive layer 10*b* is weak at the end portions of the transfer material relatively as compared with the image region. For this reason, the sufficient electric charge is not applied or induced with the result of weak attraction at the periphery of the transfer material. Therefore, as the superimposing transfer operations are carried out, the transfer material is raised or removed from the transfer drum.

SUMMARY OF THE INVENTION

Accordingly, it is a principal object of the present invention to provide an image forming apparatus or method in which the above problems are suppressed.

According to an aspect of the present invention, there is provided an image forming apparatus comprising: an electrophotographic photosensitive member; charging means for charging the photosensitive member to form an electrostatic latent image on the photosensitive member; exposure means for exposing the photosensitive member to image light; developing means for developing the latent image with toner; a transfer member contactable to the photosensitive member at transfer position, the transfer member comprising an electrically conductive base, a high resistance surface layer, and a low resistance or intermediate resistance conductive layer between the conductive base and the surface layer; and transfer voltage applying means for applying a transfer voltage to the transfer member; wherein Ws>Wt>Wp>Wl is satisfied, where Ws is a width of a photosensitive layer measured in a direction perpendicular to a movement direction of the photosensitive member, Wl is an image exposure width of the exposure means, Wp is a width of a transfer material usable with the image forming apparatus, and Wt is an overlapping width between a charging width of the charging means and the width of the conductive layer of said transfer member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

EMBODIMENT 1

Figure 1:
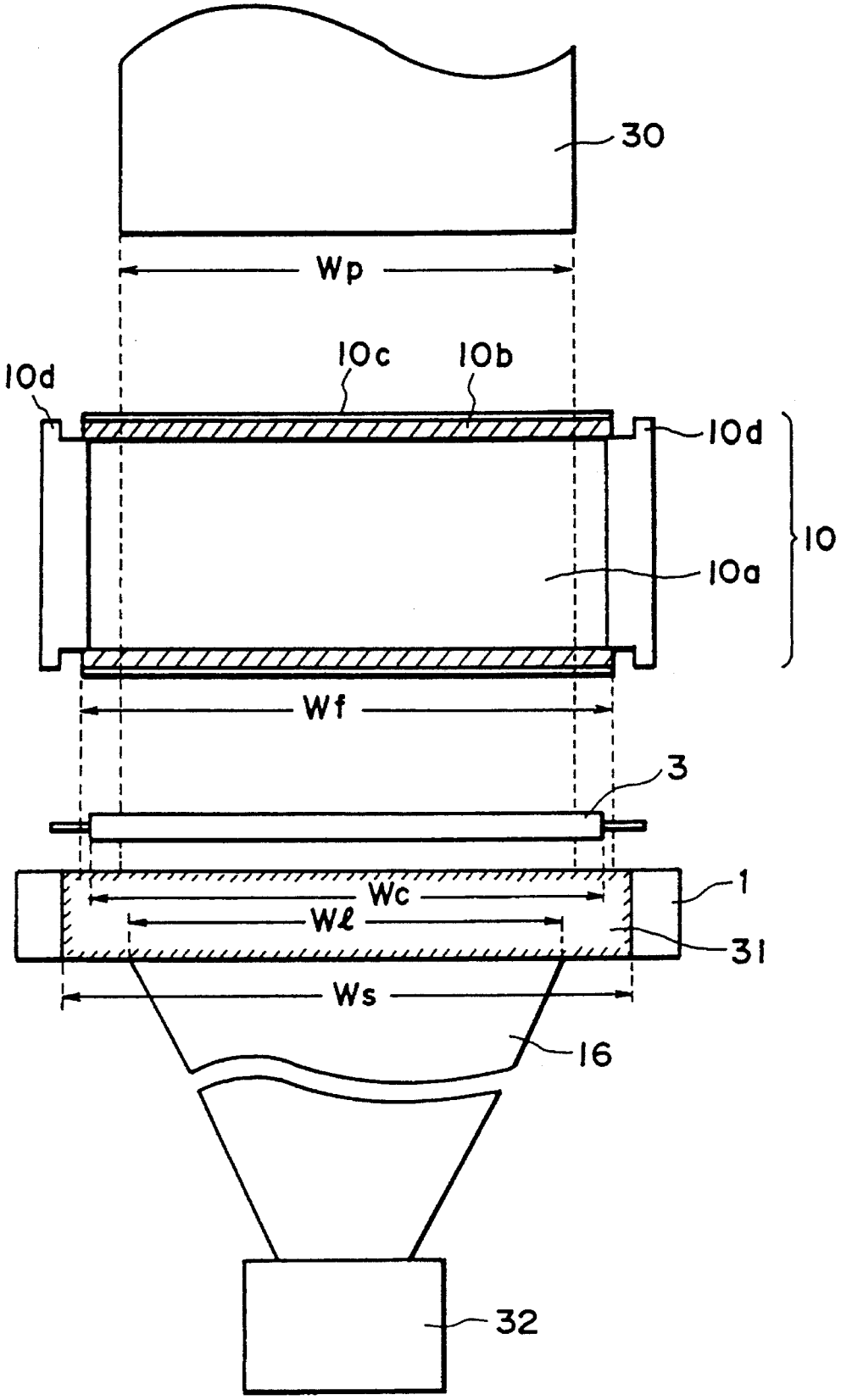
FIG. 1 is a top plan view illustrating dimensional relationship among various parts in an apparatus according to a first embodiment of the present invention.
Figure 5:
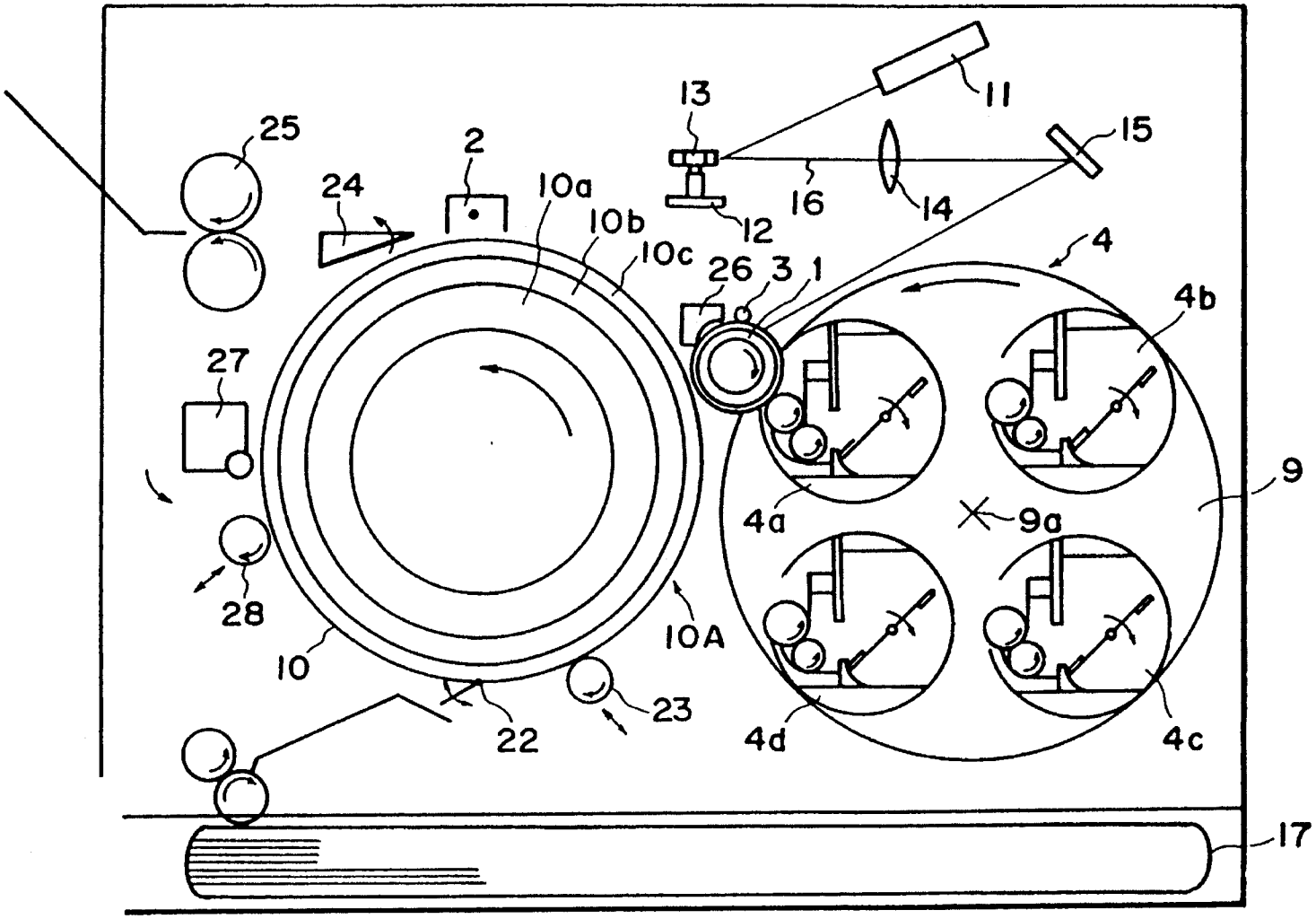
FIG. 5 is a sectional view of an image forming apparatus usable with the present invention.
Figure 6:
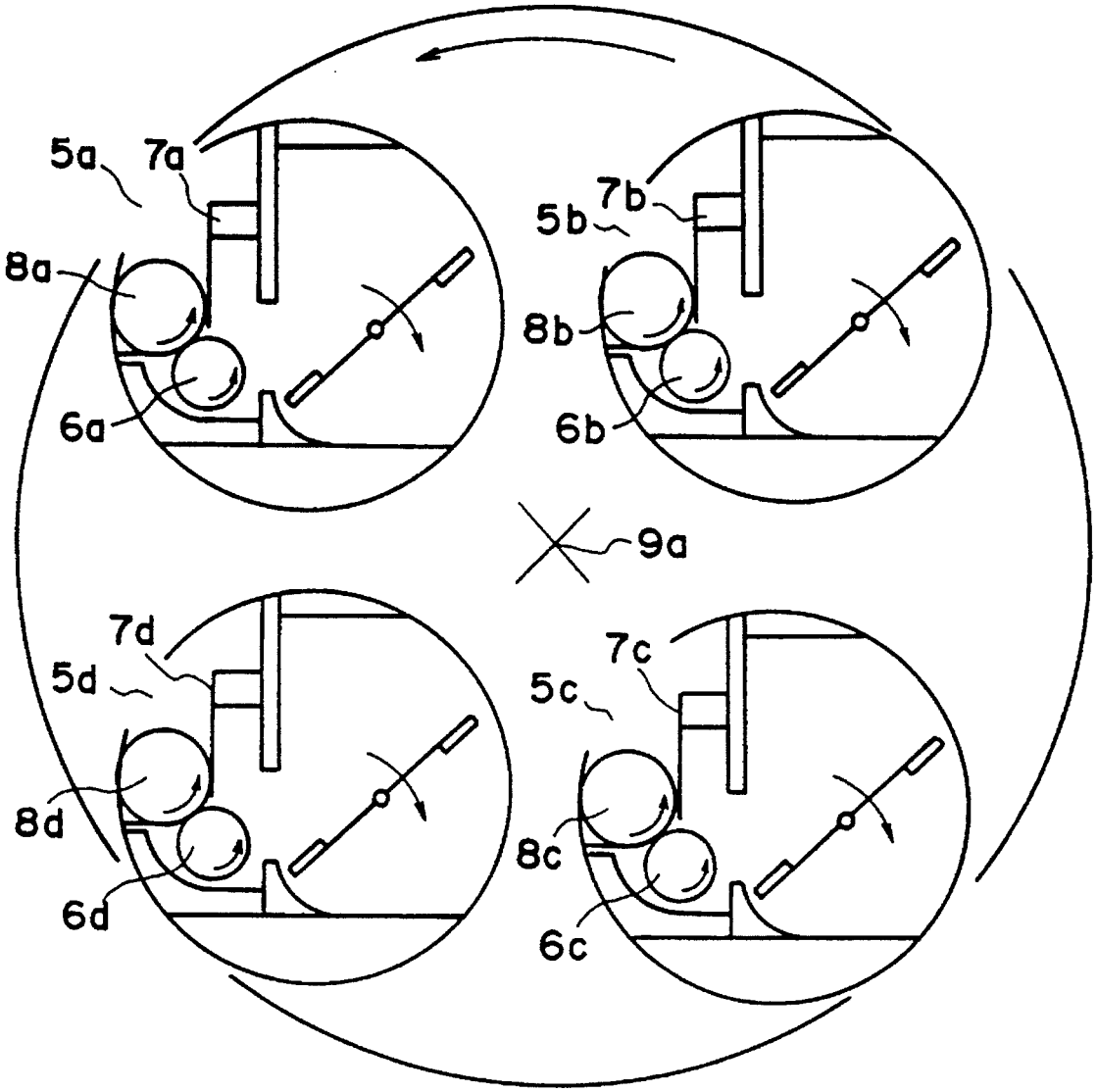
FIG. 6 illustrates a rotary developing apparatus used in the apparatus of FIG. 5.

FIG. 1 illustrates an embodiment 1 and shows a relationship in a width direction (scanning direction) of the apparatus shown in FIG. 5. The description will be made as to the case using an OPC photosensitive member 31 having a negative charging property, as the photosensitive drum 1.

The photosensitive member 31 is uniformly charged to the negative polarity by a charging roller 3 of a roller electrode type in rolling contact with the photosensitive member 31. The charging roller 3 may comprise an electroconductive elastic layer of EPDM or the like having a surface layer of urethane rubber or nylon. The total resistance thereof is $10^5$ –$10^7$ approximately. When the photosensitive layer 31 has a width Ws, and the contact length of the charging roller 3 is Wc, Ws>Wc is satisfied so as to prevent electric discharge between the substrate of the photosensitive drum 1 and the charging roller 3.

In order to charge the photosensitive drum 1 by the charging roller 3, the charging roller 3 is supplied with a voltage in the form of a DC biased AC. In this example, the bias voltage is provided by superposing a DC of 720 V and an AC of 1800 Vpp (peak-to-peak voltage). By this, the photosensitive drum 1 is uniformly charged to approx. –700 V.

As has been described with respect to the conventional example, the exposure apparatus 32 produces a scanning beam 16 by a laser diode 11 or a polygonal mirror 13 (FIG. 5) or the like, and scans the photosensitive drum 1 in a main scan direction with an image width Wl. At this time, the surface potential of the portion exposed to the beam attenuates to approx. –100 V, and the attenuated region receives the negatively charged toner. The toner image after the development is transferred onto the transfer material 30 through the transfer drum, the transfer material 30 having been retained on the transfer drum. The transfer drum 10 comprises an electrically conductive base 10*a* of aluminum or the like and an electrically conductive elastic layer 10*b* of foamed EPDM rubber having a width Wf, thickness of 5 mm, a hardness of 80 (Asker F) and a volume resistivity of not more than $10^6$ ohm.cm, on the conductive base 10*a*, and a surface layer 10*c* of urethane dielectric layer having a volume resistivity of $10^{14}$–$10^{15}$ ohm.cm and a thickness of approx. 40 μm. The contact between the transfer drum 1 and the transfer drum 10 is carried out by an abutment portion 10*d* of an insulating flange at each end of the transfer drum 10. It is pressed with a total pressure of 1000 g with an entering amount of the elastic material 10*b* of approx. 0.3 mm relative to the photosensitive drum 1. During the transfer operation, the transfer voltage VT is increased gradually from +750 V for the first color, and the voltage is sequentially added by 250 V for the second and subsequent colors.

As a result, to the surfaces of the charge portion of the photosensitive drum 1 (excluding the exposed part having the toner) and the conductive layer 10*b*, faced to each other, are subjected to strong electric field with the transfer voltage VT for each color plus the absolute value of the dark potential. Outside the charge portion, the potential of the photosensitive drum 1 is substantially 0 V, and therefore, the faced surfaces of the photosensitive drum 1 and the conductive layer 10*b*, are subjected to weak electric field provided only by the transfer voltage VT.

When a width of a portion where the charged portion of the photosensitive drum 1 and the electroconductive elastic layer 10*b* are faced to each other is Wt (Wt=Wf, because Wc>Wf in this example), the conditions of various members are selected so as to satisfy the following:

$$Ws>Wt>Wp>Wl \quad (1)$$

where Ws is a width of the photosensitive layer, Wp is a maximum width of the transfer material, and Wl is a width of image exposure.

More specifically the maximum transfer material width Wp is 210 mm (A4 size), the image exposure width We=200 mm, the charging width Wc (=Wt)=220 mm, and the conductive elastic layer width Wf is 224 mm, and the photosensitive layer width Ws is 248 mm. They are arranged so that the center thereof are aligned on a line.

By doing so, even if the transfer operation is carried out to the maximum size transfer material, the neighborhood of the ends of the transfer material are width in the width Wt, and sufficient negative charge is applied from the photosensitive layer 31 to the surface of the transfer material, and simultaneously sufficient positive charge is induced to the backside of the dielectric layer 10*c*, and therefore, the transfer material is not deviated or raised even if four color sequential transfer operation is carried out.

In the foregoing embodiment, the conductive elastic layer with Wf is larger than charging width Wc. By doing so, end portion of the elastic layer 10*b* is faced to the non-charge portion of the photosensitive layer 31, and therefore, the electric field between the elastic layer end portion and the photosensitive layer is decreased so that the spark discharge between the elastic layer end to the photosensitive layer can be prevented.

EMBODIMENT 2

In Embodiment 1, dielectric layer 10*c* of urethane resin is provided on the elastic layer 10*b* of the foamed EPDM rubber. However, it is possible that the dielectric layer 10*f* is formed by flexible sheet material of PVdF or polyimide in place of urethane material.

In this case, it is possible to set Wi≧Wf where the width of the dielectric layer 10*f* is Wi, and therefore, the electric discharge between the end portions of the elastic layer 10*b* and the photosensitive layer 31 can be easily prevented.

Figure 2:
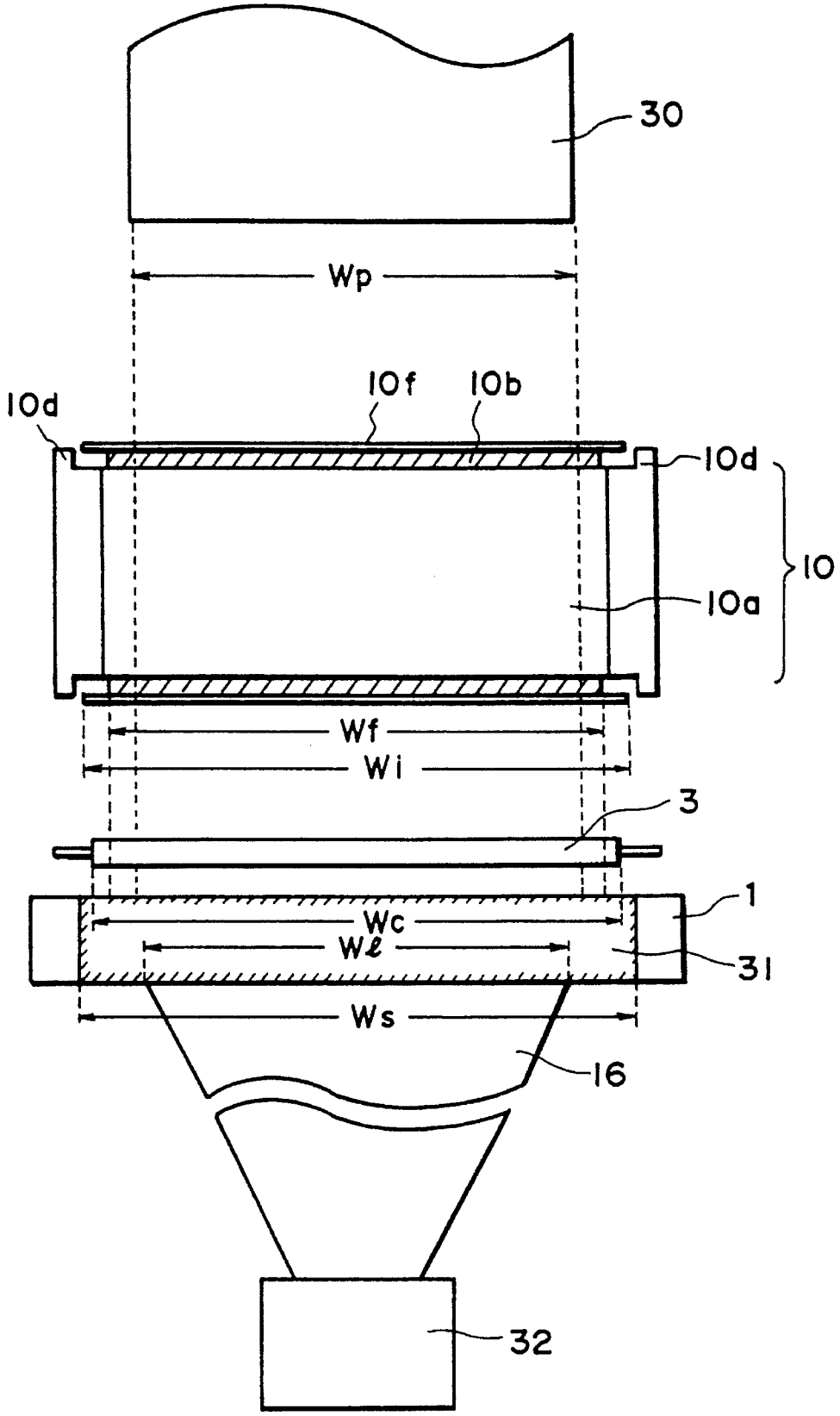
FIG. 2 is a similar view in the apparatus according to a second embodiment.

In such a case, the structure shown in FIG. 2, that is, the structure satisfying the following (2) and (3) is preferable:

$$Ws>Wc\geqq Wf>Wp \quad (2)$$

$$Wi\geqq Wf \quad (3)$$

As regards (2), if charging width Wc≧elastic layer width Wf is satisfied, the surface potential of the photosensitive layer can be made uniformly equal to the dark potential at the surface faced to the end portion of the elastic layer 10*b*, in addition to the attraction effect of the transfer material in Example 1. More particularly, the photosensitive layer 31 is subjected to the negative and positive charges alternately by the elastic layer 10*b* which is a transfer electrode and by the charging roller 3 adjacent to the end portions of the elastic layer 10*b* of the photosensitive layer 31. Then, the charge up to the positive polarity occurring when only the transfer electrode is faced, can be prevented. For this reason, the damage such as charge memory, of the OPC photosensitive layer 31 having the negative charging polarity, can be suppressed.

The photosensitive layer 31 faced to the outside of the end portions of the elastic layer 10*b*, is subjected only to the negative charging by the charging roller 3. However, because of the polarity of the photosensitive member and the potential converging effect of the charging roller 3, there arises no problem.

In an actual example, the surface layer 10*f* is of PVdF sheet having a thickness of 70 μm; the maximum transfer material width is 210 mm; conductive elastic layer width Wf is 220 mm; charging width Wc is 226 mm; the width of PVdF which is a dielectric surface layer Wi is 246 mm; and the photosensitive layer width Ws is 246 mm. They are disposed so that the centers are substantially on line. It has been confirmed then that the positive polarity charging of the photosensitive layer adjacent the end portions of the conductive elastic layer 10*b* could be prevented while maintaining good attraction property of the transfer material 30. In addition, the discharging to the photosensitive layer 31 from end portions of the electroconductive base 10*a* or the end portions of the conductive elastic layer 10*b*, could be prevented.

In FIG. 2, the width of the conductive elastic layer 10*a* is wider than the elastic layer 10*b*, but FIG. 1 arrangement is usable. In such a case, the discharge from the conductive base 10*a* to the photosensitive drum 1 is not a problem even if there is no dielectric layer 10*c*. In this example, photosensitive layer width Ws>dielectric layer width Wi, but Ws≦Wi is usable.

In the foregoing the improvement of the attraction property in the reverse development has been described in conjunction with Embodiments 1 and 2. However, in the case of the regular development, Wt>Wp in inequation (1) is not necessary, but Wt≦Wp is usable, as has been described with respect to the prior art.

In the case of the regular development, the charging by the charging member 3 and the charging at the transfer operation, have the same polarity, and therefore, even if Wc<Wf in inequation (2), is used, the photosensitive member 31 is free of the charging memory or the like.

EMBODIMENT 3

Figure 3:
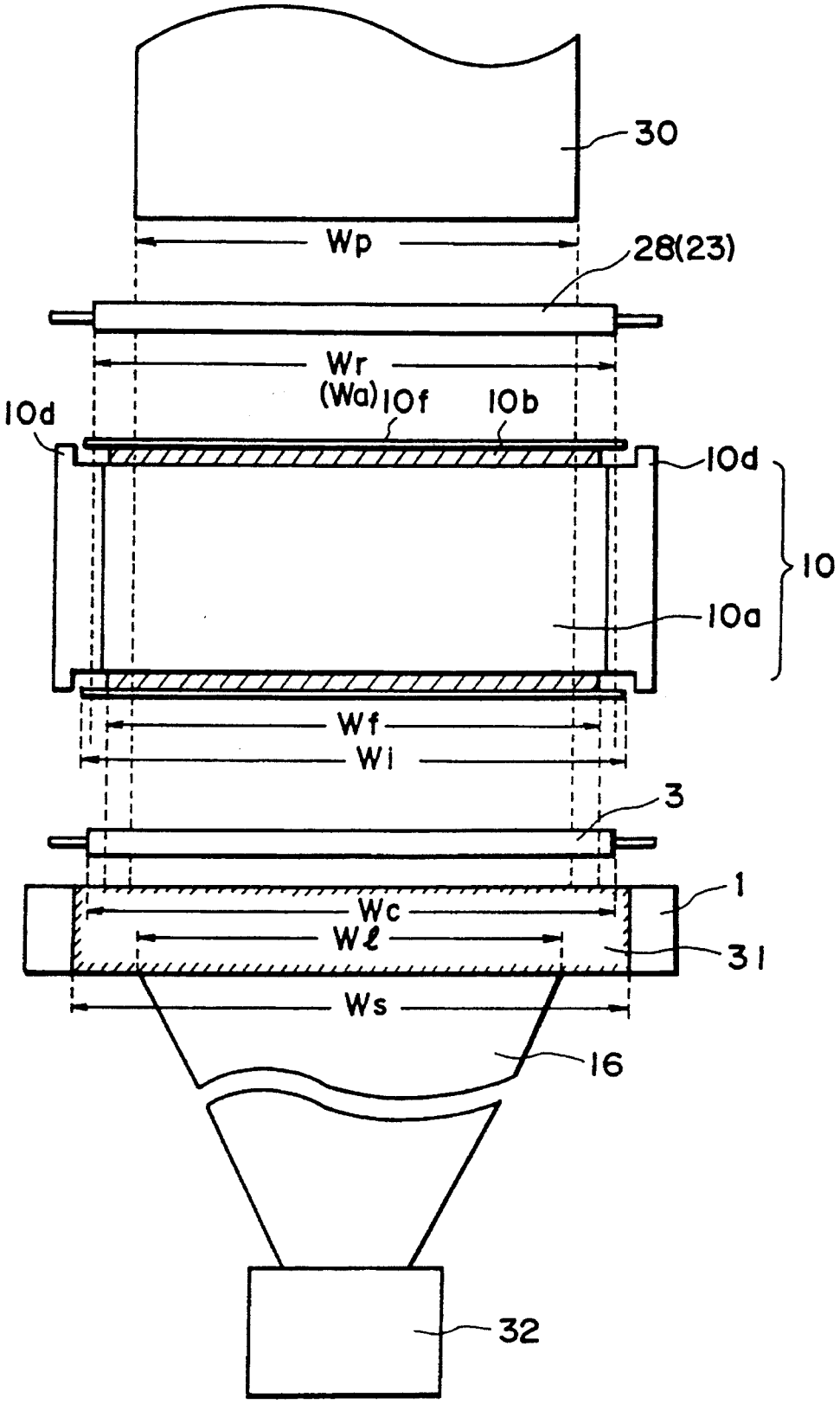
FIG. 3 is a similar view of an apparatus according to a third embodiment of the present invention.

FIG. 3 illustrates a third embodiment. In FIG. 3, the discharging roller 28 (FIG. 5) for discharging the dielectric layer 10*c* (or 10*f*) of the transfer drum 10 described with respect to the prior art, incorporates the present invention.

In FIG. 3, the charging roller 28 is in the form of a metal cylindrical roller. As an alternative, the discharging roller may be of electroconductive rubber or plastic material. When a contact length between the charging roller 28 and the transfer drum 10 is Wr, it is preferable that the following is satisfied:

$$Wr\geqq wf \quad (4)$$

If the inequation (4) and inequation (1) are satisfied, the discharging roller 28 is contacted to the transfer drum 10 during the pre-rotation or during the post rotation after the transfer operation, with proper various voltage (AC, 3 KVp approx.) applied thereto, by which the electric charge accumulated on the backside (and the front side through the transfer material) of the dielectric layer 10*c* can be electrically discharged through the conductive elastic layer 10*b* over the entire width Wf.

For this reason, during the next printing operation, it can be avoided that instable electric charge exists on the dielectric layer 10*c* to retain the end portions of the transfer sheet 30, and therefore, the attraction of the transfer material 30 on the transfer drum 10 in the transfer operation is further stabilized.

The pre-rotation and the post-rotations are the rotations through one or more turns before the start of the original image forming step to recover the photosensitive member from deterioration, or the rotation through one or more turns after the image formation to electrically discharge the surface potential of the photosensitive member.

EMBODIMENT 4

In Embodiment 4, the description has been made with respect to the incorporation into the discharging roller 28. However, the present invention is applicable to the attraction roller 23 (FIG. 5) which is an auxiliary attraction means in the conventional example described hereinbefore. In this case, it is preferable that the following (5) is satisfied:

$$Wa \geqq Wf \quad (5)$$

where, Wa is a contact length between the attraction roller 23 and the transfer drum 10 (see FIG. 3). As an example, electroconductive chloroprene rubber roller is used as the attraction roller 23, and prior to the first rotation, the transfer material 30 is contacted to the backside of the transfer drum 10 by the attraction roller 23. The attraction roller 23 is supplied with a bias voltage of −1000 V relative to the base 10*a* of the transfer drum, by which the transfer material 30 is auxiliary attracted to the dielectric layer 10*c* of the transfer drum.

As a result, the electric charge is induced to the surface of the transfer material 30 and the back surface of the dielectric layer 10*c* by the electric field formed between the attraction roller 23 and the conductive elastic layer 10*b*. When Wa and Wf are so related that Wa is 230 mm, and Wf=220 mm, the satisfactory auxiliary attraction can be confirmed. Thereafter, in the transfer station, the above-described (1) is satisfied, by which the transfer material 30 is further strongly attracted to the transfer drum 10.

Particularly in the structure using the elastic layer 10*b*, the contacting property between the transfer material and the transfer drum are different between beforehand after the transfer operation. For example, positional deviation may occur between the first color transfer with insufficient attraction and the second and subsequent transferred with sufficient attraction. By the use of the attraction roller 23 satisfying the inequation (5), the misregistration of the first color transfer can be avoided.

EMBODIMENT 5

In Embodiment 1, the elastic layer 10*b* of electroconductive EPDM rubber is opposed as an opposite electrode for the photosensitive layer 31, and the attracting and transfer operations are carried out. However, the use of the conductive elastic layer is not inevitable. It is possible that low or intermediate conductive layer is disposed between the elastic layer and the dielectric high resistance surface layer 10*c* (or 10*f*), and it is used as an opposite electrode for the photosensitive layer 31 as in the present embodiment.

Figure 4:
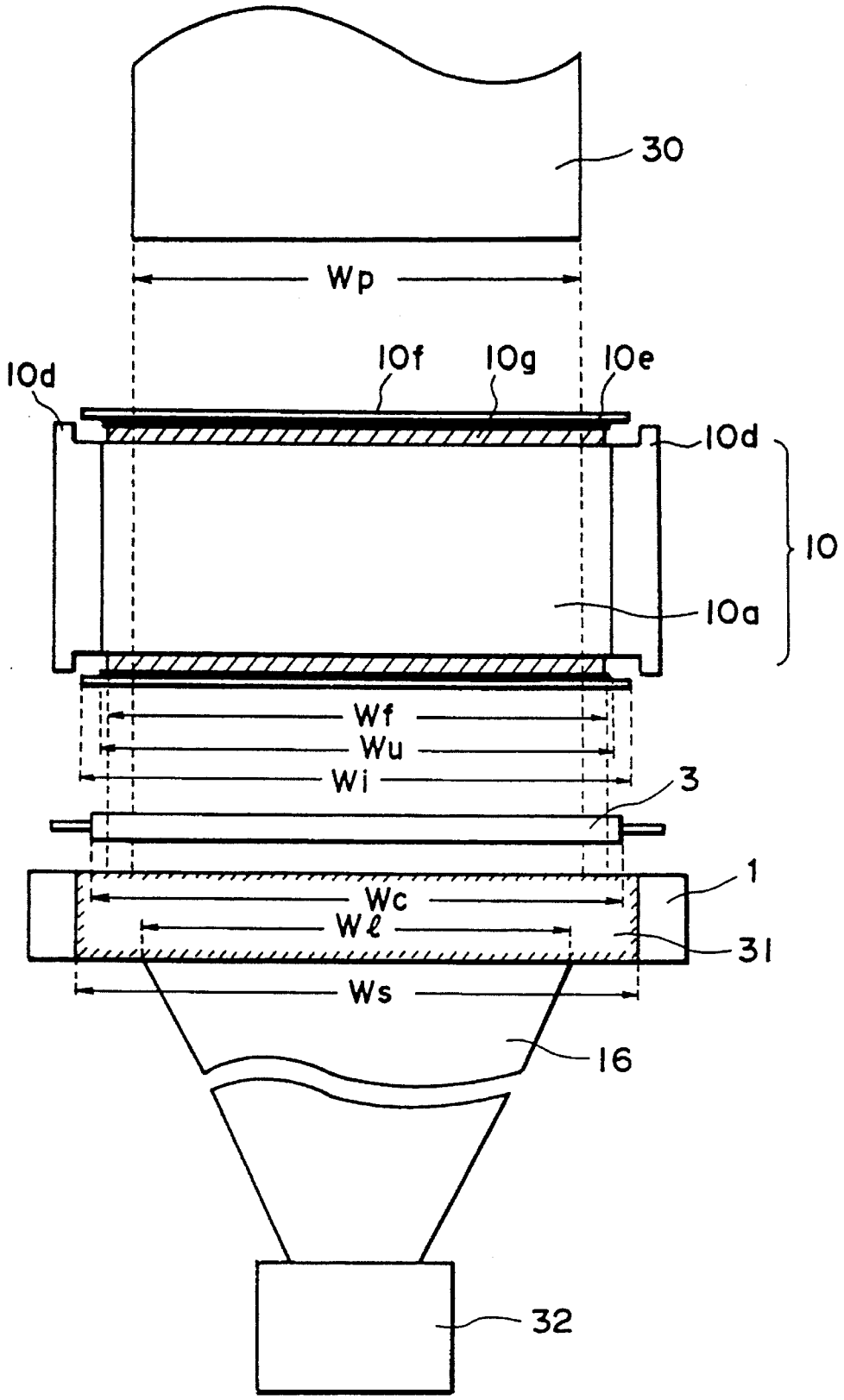
FIG. 4 is a similar view of an apparatus according to a fifth embodiment of the present invention.

As an example, as shown in FIG. 4, the surface layer is of PVdF film as in Embodiment 2. A conductive layer 10*e* is provided at the backside thereof by aluminum evaporation into a thickness of 1000Å, as an opposite electrode for the photosensitive layer 31. As for the elastic layer, a high resistance EPDM rubber is used. The conductive layer 10*e* and the conductive base 10*a* are provided with an unshown electrode at a longitudinal end or a circumference not supporting the transfer material, so that the electric connection is established.

With the three layer structure of the transfer member, the function separation is possible by the elastic layer, the electrode layer and the dielectric layer. For example, in order to increase the electroconductivity of the elastic layer 10*g*, if carbon or the like is dispersed, the hardness is increased. Such a problem can be avoided by the function separation.

In this embodiment, the elastic layer 10*g* is not treated for the electroconductivity, by which the hardness can be decreased to 60–70 degrees (Asker F). Accordingly, the contact pressure between the photosensitive drum 1 and the transfer drum 10 can be decreased to not more than 400 G (total pressure). By this, the central void of the transfer (the central portion of a character or the like is not transferred, only the edge portions are transferred), can be suppressed.

In this embodiment, the width Wu of the conductive layer 10*e* (intermediate layer) measured in the direction of the axis, the overlapping width Wz between the charge portion of the photosensitive drum 1 and the conductive layer 10*e*, and the overlapping width Wz between the charge portion of the photosensitive drum 1 and the conductive layer 10*e*, are selected to satisfy the following inequation (6):

$$Ws > Wz > Wp > Wl \quad (6)$$

In the actual example, the maximum transfer material width Wp is 210 mm (A4 size); the image exposure width Wl is 200 mm; charging width Wc is 226 mm; conductive layer width Wu is 222 mm; the photosensitive layer width Ws is 240 mm; and Wz is 222 mm, the same as Wu.

As a result, the same advantageous effects as described in conjunction with Embodiment 1, have been provided as regards attraction property.

In the axial example, the width Wi of the dielectric layer 10*f* (surface layer) is 246 mm, and therefore, the following inequations (7) and (8) are simultaneously satisfied:

$$Ws > W \geqq Wu > Wp \quad (7)$$

$$Wi \geqq Wf \quad (8)$$

These corresponds to the inequations (2) and (3) in Embodiment 2. As will be readily understood, the same advantageous effects as in Embodiment 2 can be provided by satisfying the inequations (7) and (8) in this embodiment.

In FIG. 4, the width Wf of the elastic layer 10*g* satisfies Wf<Wu. When the resistance of the elastic layer 10*g* is high, the charge memory of the photosensitive layer 31 or the discharge at the end portions are not reliable even if Wf≧Wu, Wf≧Wc, Wf≧Wi or the like is satisfied.

The inequation (4) or (5) in Embodiments 3 and 4 may be changed to the following inequations (9) and (10) by changing Wf to Wu:

$$Wr \geqq Wu \quad (9)$$

$$Wa \geqq Wu \quad (10)$$

where Wr is a discharge width of the above-described charging means, and Wa is an acting width of the auxiliary attraction means. The advantageous effects provided by satisfying these conditions are the same as in Embodiments 3 and 4.

The image forming process in each of the above-embodiments, the electrophotographic photosensitive member is uniformly charged, and thereafter, light information is applied to form an electrostatic latent image, and it is reverse-development. However, the present invention is effective to another electrophotographic process in which the light information is applied simultaneously with charging or simultaneously with light projection.

As regards the electroconductivity of the transfer member, it is not inevitable that the conductive layer itself has the elasticity. If, however, the electroconductive layer does not have the elasticity, an insulative layer (dielectric layer) or the like or another member may be given the electroconductivity.

As described in the foregoing, according to the embodiments, the transfer material 30 can be attracted on the transfer member with stability. In addition to the improvement in the attracting property, the memory of the photosensitive layer of the photosensitive member and the electric discharge from the conductive layer, can be prevented.

In the embodiment using the elastic layer, the latitude in the prescription to reduce the hardness of the elastic layer is increased to reduce the problem of the central void of transfer, and the transfer material can be attracted properly on the transfer member.

According to the embodiments, the toner image transfer onto the transfer drum is carried out while the transfer material is attracted on the transfer material. However, a toner image formed on a dielectric member may be transferred onto a transfer material. In order to accomplish this, the corona discharger 2 of FIG. 5 Or a voltage application means such as a roller electrode 28 are used as the transfer means. That is, the toner image formed on a dielectric material is transferred onto the transfer material by contacting the transfer material to the toner image and a transfer bias is applied by the transfer means.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an electrophotographic photosensitive member;

charging means for charging said photosensitive member to form an electrostatic latent image on said photosensitive member;

exposure means for exposing said photosensitive member to image light;

developing means for developing the latent image with toner;

a transfer member contactable to said photosensitive member at a transfer position, said transfer member comprising an electrically conductive base, a high resistance surface layer, and a low resistance or intermediate resistance conductive layer between said conductive base and said surface layer; and transfer voltage applying means for applying a transfer voltage to said transfer member;

wherein $Ws>Wt>Wp>Wl$ is satisfied, where Ws is a width of a photosensitive layer measured in a direction perpendicular to a movement direction of said photosensitive member, Wl is an image exposure width of said exposure means, Wp is a width of a transfer material usable with said image forming apparatus, and Wt is an overlapping width between a charging width of said charging means and the width of the conductive layer of said transfer member.

2. An apparatus according to claim 1, wherein $Ws>Wc \geqq Wf>Wp$, and $Wi \geqq Wf$ are satisfied, where Wf is a width of the conductive layer of said transfer material, Wi is a width of the surface layer of said transfer member, and Wc is a charging width of said charging means.

3. An apparatus according to claim 1, wherein said developing means is a reverse developing means.

4. An image forming apparatus comprising:

an electrophotographic photosensitive member;

charging means for charging said photosensitive member to form an electrostatic latent image on said photosensitive member;

exposure means for exposing said photosensitive member to image light;

developing means for developing the latent image with color toner;

a transfer member for carrying a transfer material, contactable to said photosensitive member at a transfer position, said transfer member comprising an electrically conductive base, a high resistance surface layer, and a low resistance or intermediate resistance conductive layer between said conductive base and said surface layer; and transfer voltage applying means for applying transfer voltages to said transfer member to transfer color toner images;

wherein $Ws>Wt>Wp>Wl$ is satisfied, where Ws is a width of a photosensitive layer measured in a direction perpendicular to a movement direction of said photosensitive member, Wl is an image exposure width of said exposure means, Wp is a width of a transfer material usable with said image forming apparatus, and Wt is an overlapping width between a charging width of said charging means and the width of the conductive layer of said transfer member.

5. An apparatus according to claim 4, wherein $Ws>Wc \geqq Wf>Wp$, and $Wi \geqq Wf$ are satisfied, where Wf is a width of the conductive layer of said transfer material, Wi is a width of the surface layer of said transfer member, and Wc is a charging width of said charging means.

6. An apparatus according to claim 4, further comprising discharging means, opposed to said transfer member, for discharging said transfer member, wherein $Wr \geqq Wf$ is satisfied, where Wr is a discharging width of said discharging means, and Wf is a width of the conductive layer of said transfer member.

7. An apparatus according to claim 4, further comprising attraction means, opposed to said transfer member, for electrostatically attracting the transfer material to said transfer member, wherein said attraction charging means has a charging width Wa, and is a width Wf of the conductive elastic layer of said transfer member satisfy $Wa \geqq Wf$.

8. An apparatus according to claim 4, wherein the conductive layer of said transfer member has an elasticity.

9. An apparatus according to claim 8, wherein the conductive layer has elasticity provided by a foamed material, and the conductive layer is coated with the high resistance surface layer.

10. An apparatus according to claim 4, wherein said developing means is a reverse developing means.

11. An image forming apparatus comprising:

an electrophotographic photosensitive member movable along an endless path;

charging means for charging said photosensitive member to form an electrostatic latent image on said photosensitive member;

exposure means for exposing said photosensitive member to image light;

developing means for developing the latent image with color toner;

a transfer member for carrying a transfer material contactable to said photosensitive member at a transfer position, said transfer member comprising an electrically conductive base, a high resistance surface layer, an elastic layer and a low resistance or intermediate resistance conductive layer between said conductive base and said surface layer; and transfer voltage applying means for applying transfer voltages to said transfer member to transfer color toner images;

wherein Ws>[Wt]WZ>Wp>Wl is satisfied, where Ws is a width of a photosensitive layer measured in a direction perpendicular to a movement direction of said photosensitive member, Wl is an image exposure width of said exposure means, Wz is an overlapping width between the width of said photosensitive member, the width of the charging member, and the width of the conductive layer of the transfer member, and WP is width of a transfer material usable with said image forming apparatus.

12. An apparatus according to claim 11, wherein Ws>Wc≧Wu>Wp, and [Wi≧Wu] Wi≧Wu are satisfied, where Wu is a width of the conductive layer of said transfer material, Wi is a width of the surface layer of said transfer member, and Wc is a charging width of said charging means.

13. An apparatus according to claim 11, further comprising discharging means, opposed to said transfer member, for discharging said transfer member, wherein Wr≧Wu is satisfied, where Wr is a discharging width of said discharging means, and Wu is a width of the conductive layer of said transfer member.

14. An apparatus according to claim 11, further comprising attraction means, opposed to said transfer member, for electrostatically attracting the transfer material to said transfer member, wherein said attraction charging means has a charging width Wa, and a width Wu of the conductive elastic layer of said transfer member, satisfy Wa≧Wu.

15. An apparatus according to claim 11, wherein the conductive layer of said transfer material has a width larger than that of the elastic layer.

16. An apparatus according to claim 11, wherein the conductive layer of said transfer material is the same or smaller than that of the elastic layer.

17. An apparatus according to claim 11, wherein said developing means is a reverse developing means.

18. An image forming apparatus comprising:

an electrophotographic photosensitive member;

charging means for charging said photosensitive member to form an electrostatic latent image on said photosensitive member;

exposure means for exposing said photosensitive member to image light;

developing means for developing the latent image with color toner;

a transfer member contactable to said photosensitive member at a transfer position, said transfer member comprising an electrically conductive base, a high resistance surface layer, an elastic layer and a low resistance or intermediate resistance conductive layer between said conductive base and said surface layer; and transfer voltage applying means for applying transfer voltages to said transfer member to transfer color toner images;

transfer means for transferring the toner images all together onto a transfer material from said transfer member, wherein Ws>Wt>Wp>Wl is satisfied, where Ws is a width of a photosensitive layer measured in a direction perpendicular to a movement direction of said photosensitive member, Wl is an image exposure width of said exposure means, Wp is a width of a transfer material usable with said image forming apparatus, and Wt is an overlapping width between a charging width of said charging means and the width of the conductive layer of said transfer member.

19. An apparatus according to claim 18, wherein said developing means is a reverse developing means.

* * * * *

UNITED STATES PATENT AND TRADEMARK OFFICE

CERTIFICATE OF CORRECTION

PATENT NO. : 5,608,505

DATED : March 4, 1997

INVENTOR(S) : Akihiko Takeuchi, et al.

It is certified that error appears in the above-indentified patent and that said Letters Patent is hereby corrected as shown below:

COLUMN 5

Line 8, "and-the" should read --and the--.

COLUMN 10

Line 53, "W" should read --Wc--.

COLUMN 13

Line 38, "width" should read --a width--.

Signed and Sealed this

Twenty-sixth Day of August, 1997

*Attest:*

Bruce Lehman

BRUCE LEHMAN

*Attesting Officer*

*Commissioner of Patents and Trademarks*